US011713150B2

(12) United States Patent
Speck et al.

(10) Patent No.: US 11,713,150 B2
(45) Date of Patent: Aug. 1, 2023

(54) TUBE HOLDER FOR A TUBE-FILLING MACHINE

(71) Applicant: IWK Verpackungstechnik GmbH, Stutensee (DE)

(72) Inventors: Markus Speck, Bruchsal (DE); Andreas Siegele, Stutensee (DE); Rudolf Hörter, Wörth (DE)

(73) Assignee: IWK Verpackungstechnik GmbH, Stutensee (DE)

( * ) Notice: Subject to any disclaimer, the term of this patent is extended or adjusted under 35 U.S.C. 154(b) by 415 days.

(21) Appl. No.: 16/506,120

(22) Filed: Jul. 9, 2019

(65) Prior Publication Data

US 2020/0017247 A1 Jan. 16, 2020

(30) Foreign Application Priority Data

Jul. 12, 2018 (DE) ..... 10 2018 005 511.7

(51) Int. Cl.
*B65B 43/54* (2006.01)
*B65B 3/16* (2006.01)

(52) U.S. Cl.
CPC ..... *B65B 43/54* (2013.01); *B65B 3/16* (2013.01)

(58) Field of Classification Search
CPC ..... B65B 3/16; B65B 43/42–54
See application file for complete search history.

(56) References Cited

U.S. PATENT DOCUMENTS 2,929,653 A * 3/1960 Hund ..... B65B 21/12 294/90
3,178,217 A * 4/1965 Bargel ..... B65B 21/12 294/90
3,831,995 A * 8/1974 Duncan ..... B65G 47/908 294/119.3
4,048,783 A * 9/1977 Raudat ..... B65B 39/006 53/497
4,176,425 A * 12/1979 Trutzschler ..... D01G 7/06 19/81

(Continued)

FOREIGN PATENT DOCUMENTS

DE 102006055854 A1 5/2008
EP 2886471 A1 * 6/2015 ..... B65B 3/16

(Continued)

OTHER PUBLICATIONS

ESPACENET machine translation of EP-2886471-A1 (Year: 2015).*

*Primary Examiner* — Anna K Kinsaul
*Assistant Examiner* — Himchan Song
(74) *Attorney, Agent, or Firm* — McGlew and Tuttle, P.C.

(57) ABSTRACT

A tube holder for a tube-filling machine has a cup-shaped housing, which has an upwardly opening tube mount, into which a tube can be inserted with an axial end area thereof. A clamping device, by which a clamping force can be applied to the tube, is arranged in the area of the tube wall of the tube mount. Provisions are made for the clamping device to have at least one inflatable clamping element with an inner chamber, into which a pressurized fluid can be filled through a feed line. The clamping element can be adjusted between a clamping position, in which a clamping force is applied to the tube, and a releasing position, in which no clamping force is applied to the tube, and a releasing position, in which no clamping force is preferably applied to the tube.

7 Claims, 2 Drawing Sheets

(56) References Cited

U.S. PATENT DOCUMENTS

| | | | | | |
|---|---|---|---|---|---|
| 4,486,045 | A * | 12/1984 | Trygg | B65B 21/12 | 294/119.3 |
| 4,835,946 | A * | 6/1989 | Hartness | B65B 21/06 | 53/247 |
| 4,958,667 | A * | 9/1990 | Rece | B65B 43/54 | 269/254 R |
| 5,083,824 | A * | 1/1992 | Sato | B65G 47/908 | 294/119.3 |
| 5,090,759 | A * | 2/1992 | Sato | F16L 17/10 | 269/22 |
| 5,687,874 | A | 11/1997 | Omori et al. | | |
| 6,460,691 | B1 * | 10/2002 | Gaensewig | B65B 43/52 | 198/793 |
| 8,210,546 | B2 * | 7/2012 | Kohler | B65B 3/16 | 279/23.1 |

FOREIGN PATENT DOCUMENTS

| | | | |
|---|---|---|---|
| JP | H0398826 | A | 4/1991 |
| KR | 200447797 | Y1 | 2/2010 |

* cited by examiner

TUBE HOLDER FOR A TUBE-FILLING MACHINE

CROSS REFERENCE TO RELATED APPLICATIONS

This application claims the benefit of priority under 35 U.S.C. § 119 of Application 10 2018 005 511.7, filed Jul. 12, 2018, the entire contents of which are incorporated herein by reference.

TECHNICAL FIELD

The present invention pertains to a tube holder for a tube-filling machine, with a cup-shaped housing, which has an upwardly opening tube mount, into which a tube can be inserted with an axial end area thereof, wherein a clamping device, by means of which a clamping force can be applied to the tube, is arranged in the area of the tube wall of the tube mount.

TECHNICAL BACKGROUND

A tube-filling machine of a usual configuration has an endlessly circulating conveying device, which carries a plurality of mounts, into which a tube holder each is inserted. A tube can be inserted with its head section or cap section from the top into each tube holder, the tube passing together with its tube holder through the individual work stations of the tube-filling machine. Provisions may be made in certain work stations, for example, the filling station and the sealing station, for the tube to be lifted with its tube holder out of the tube mount and into the respective work station, and it is again lowered into the tube mount after completion of the working step. The filled and sealed tube is removed from the tube holder and is moved away.

A tube holder of the type mentioned, in which at least one clamping element, which can be displaced essentially at right angles to the central longitudinal axis of the tube mount and by means of which a clamping force acting on the inserted tube from radially outwards can be applied to the inserted tube under the action of at least one spring element, is arranged in the area of the inner wall of the tube mount, is known from DE 10 2006 055 854 A1. The clamping element is mounted in this case pivotably.

The designations "top" and "bottom" used here are related to the usual orientation of a tube holder with an upwardly opening tube mount, into which the tube with its head section or cap section can be inserted from the top, so that the tube protrudes from the tube holder on the top side with its end, which is to be sealed. In case of such an orientation of the tube holder, the central longitudinal axis of the tube holder extends vertically, and the clamping forces clamping the tube in the tube holder are applied essentially at right angles to the central longitudinal axis and hence essentially horizontally.

To make it possible to operate the tube-filling machine with a high cycle number, it is necessary for the tubes to be positioned accurately in the tube holder. The problem arises in this connection that many tubes of different shapes, especially with different cap shapes and different tube body shapes, must be processed with the tube-filling machine. Moreover, it was found that the tubes are subject to relatively great dimensional tolerances, as a result of which it is very difficult to achieve an accurate positioning and especially centering of the tube in the tube holder.

SUMMARY

A basic object of the present invention is to provide a tube holder of the type mentioned, with which secure holding and good centering of tubes of different formats is guaranteed.

This object is accomplished according to the present invention by a tube holder for a tube-filling machine, with a cup-shaped housing, which has an upwardly opening tube mount, into which a tube can be inserted with an axial end area thereof, wherein a clamping device, by means of which a clamping force can be applied to the tube, is arranged in the area of the inner wall of the tube mount. Provisions are made in this case for the clamping device to have at least one inflatable clamping element with an inner chamber, into which a fluid can be filled under pressure through a feed line, so that the clamping element is adjustable between a clamping position, in which a clamping force is applied to the tube, and a releasing position. No clamping force or only such a weak clamping force will preferably act on the tube in the released position such that the tube can be inserted into and removed from the tube mount in a simple manner despite the weak clamping force.

A gas and especially air is preferably used as the fluid.

The present invention is based on the adjustment of the clamping element between the clamping position and the releasing position being elicited by a pressurized fluid, especially gas, which is fed in from the outside. When the tube holder is empty, i.e., no tube is seated in the tube mount, the clamping element is in its releasing position. A tube can then be inserted into the tube mount, and the pressurized fluid is filled into the inner chamber of the clamping element, as a result of which the clamping element is elastically deformed into its clamping position. The clamping element is in contact with the outer side of the tube in this clamping position and applies a clamping force to this, so that the tube is held securely in the tube mount. The tube holder with the inserted tube can be conveyed through the work stations in this clamping position of the clamping element. When the tube must be removed from the tube holder or must be lifted out of same, the overpressure in the inner chamber is released, whereupon the clamping element returns into its releasing position and it releases the tube. The clamping element can preferably be returned into the releasing position by inner restoring forces as a consequence of elastic deformation.

A soft-elastic plastic and especially a thermoplastic elastomer is preferably used as the material for the clamping element. The clamping element should preferably have high elastic deformability, as a result of which it can be achieved that it can adapt itself well to the shape of the tube and it can hold the tube with a high level of security even in case of nonround tubes or in case of tubes that have a relatively great deviation from their desired shape.

The tube holder usually has a vertically oriented, duct-shaped tube mount. In a preferred embodiment of the present invention, at least one recess, which extends radially outwards from the tube mount and in which the clamping element is arranged, is formed in the inner wall of the tube mount, and the clamping element can be deformed by the action of the pressurized fluid into a position in which it protrudes into the tube mount and especially into the clamping position. The clamping element is preferably withdrawn completely into the recess in the releasing position, so that it does not exert any clamping force on the tube inserted into the tube mount. When a deformation of the clamping element takes place by means of the pressurized fluid, the clamping element is adjusted radially inwards into the tube mount, and it is thus tensioned against the tube located there.

Provisions may be made in a possible embodiment of the present invention for the recess to be configured as a circular ring groove. A plurality of clamping elements may be arranged in the ring groove preferably distributed uniformly over the circumference, provisions being preferably made for the clamping element to have a ring-shaped configuration and for its inner chamber thus to be a ring chamber.

As an alternative, a plurality of ring chambers, to which either the same internal pressure is admitted from a single pressure source, may be provided in the clamping element, or, as an alternative, it is also possible to feed a fluid with a different pressure to individual ring chambers in order also to be able to hold greatly asymmetric tubes securely.

The clamping element preferably fills the recess completely and may be fixed in this in a positive-locking and/or non-positive manner, for example, by friction or by means of a bonding.

A filling valve and especially a proportional valve may be arranged in the feed line, through which the pressurized fluid is fed to the inner chamber of the clamping element.

Provisions are made in a preferred embodiment of the present invention for the housing of the tube holder to be able to be placed on a base part in a detachable manner. A coupling device, via which the section of the feed line that is arranged in or at the housing can be connected in a pressure-proof manner to a section of the feed line, which section is arranged in or at the base part, may be provided in the feed line between the housing and the base part.

The housing can be placed on the base part and held on same, for example, magnetically. As soon as the housing has been placed on the base part in a correct manner, the coupling device is closed, and it is possible to introduce the pressurized fluid in this position into the inner chamber of the clamping element or to drain it off from same.

Provisions may be made for draining off the pressurized fluid from the inner chamber of the clamping element for arranging in the coupling device a nonreturn valve, which is opened automatically by placing the housing on the base part, for example, by a valve element of the nonreturn valve running against a stop and being displaced, as a result of which the nonreturn valve is opened.

The coupling device in the feed line is preferably located between the filling valve and the inner chamber of the clamping element, so that the filling valve is not arranged at the housing but is rather arranged either at the base part or away from this.

Further details and features of the present invention can be seen in the following description of an exemplary embodiment with reference to the drawings.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
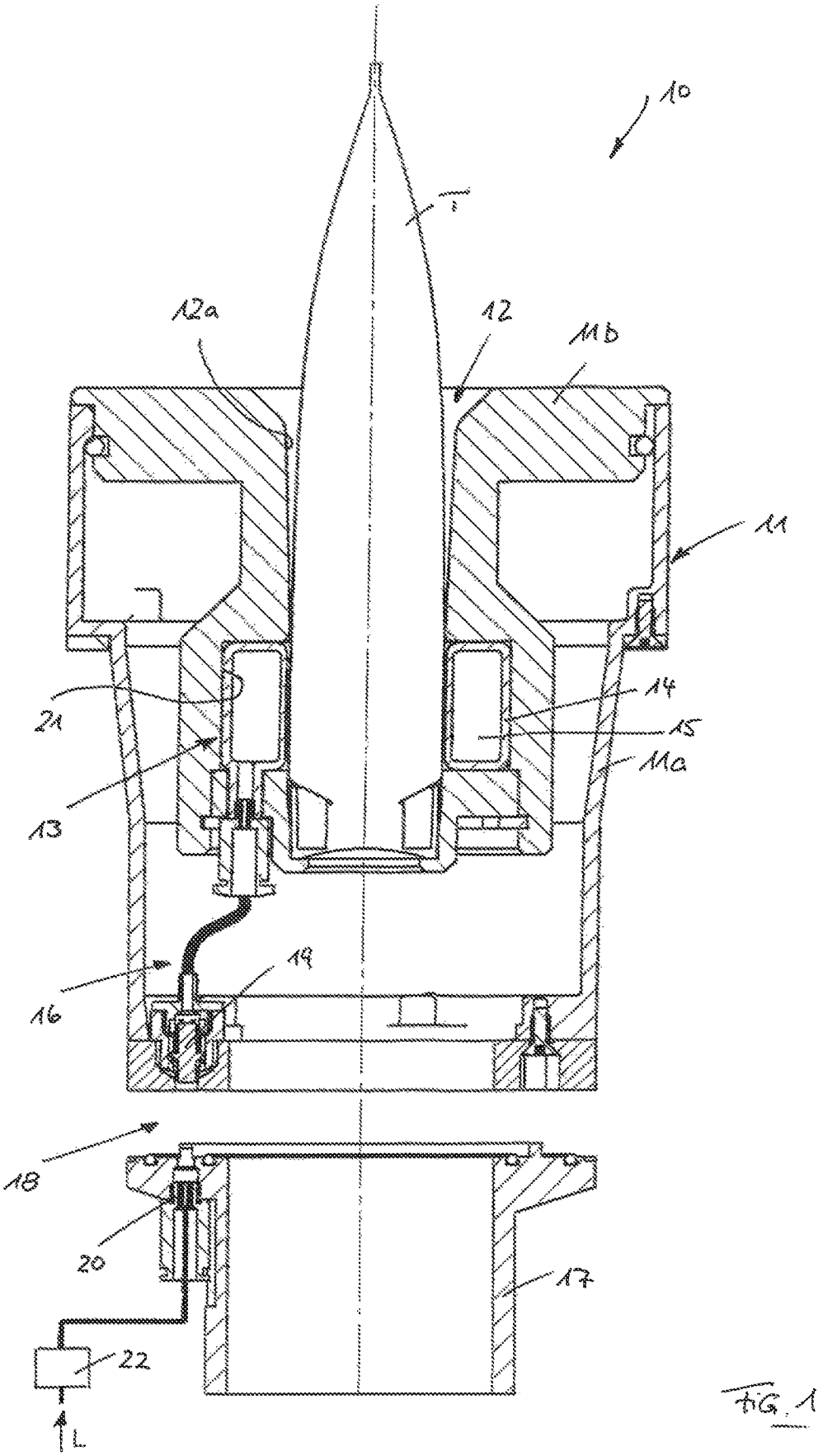
FIG. 1 is a sectional view of a tube holder in the releasing position.

Referring to the drawings, a tube holder 10 shown in FIG. 1 has a cup-shaped housing 11 with an outer, likewise cup-shaped housing base part 11*a*, into which a housing insert part 11*b* is inserted. A cylindrical, vertical through hole, which forms a tube mount 12 and has an inner wall 12*a*, is formed in the housing insert part 11*b*. A circular, ring groove-like recess 21, into which a clamping element 14 consisting of a soft elastic, easily deformable material is inserted such that the clamping element 14 fills the recess 21 completely and forms a section of the circumferential limitation of the tube mount 12, is formed in the lower area of the axial length of the tube mount 12 and the inner wall 12*a* thereof.

The clamping element 14 has a ring-shaped configuration and has an inner chamber 15 in the form of a ring chamber. As shown in the drawings, the elastic deformable material of the clamping element 14 surrounds the inner chamber 15. The clamping element 14 is part of a clamping device 13, with which the tube T can be firmly clamped in the tube mount 12.

The clamping device 13 comprises, furthermore, a feed line 16, which opens in the inner chamber 15 of the clamping element 14. A first coupling part 19 of the feed line 16, which coupling part can come into interaction with a second coupling part 20 of the feed line 16, which latter coupling part is formed in a base part 17, is formed in the bottom of the housing 11. The housing 11 can be placed on the base part 17 and is held on same by clamping, locking or preferably magnetically. When the housing 11 has been placed on the base part 17, a fluid-tight connection is present between the first coupling part 19 of the housing 11 and the second coupling part 20 of the base part 17.

A filling valve 22, suggested only schematically, is provided in the feed line 16, the coupling device 18 being arranged between the filling valve 22 and the inner chamber 15 of the clamping element 14. As is suggested by arrow L, compressed air can be introduced into the inner chamber 15 of the clamping element 14 through the feed line 16. Since the clamping element 14 is seated with a close fit in the recess 21 of the housing 11, admission of pressure into the inner chamber 15 causes the wall of the clamping element 14, which wall faces the tube T, to become deformed inwardly, i.e., in the direction of the tube, and to become tensioned against the tube, as it is shown in FIG. 2.

Figure 2:
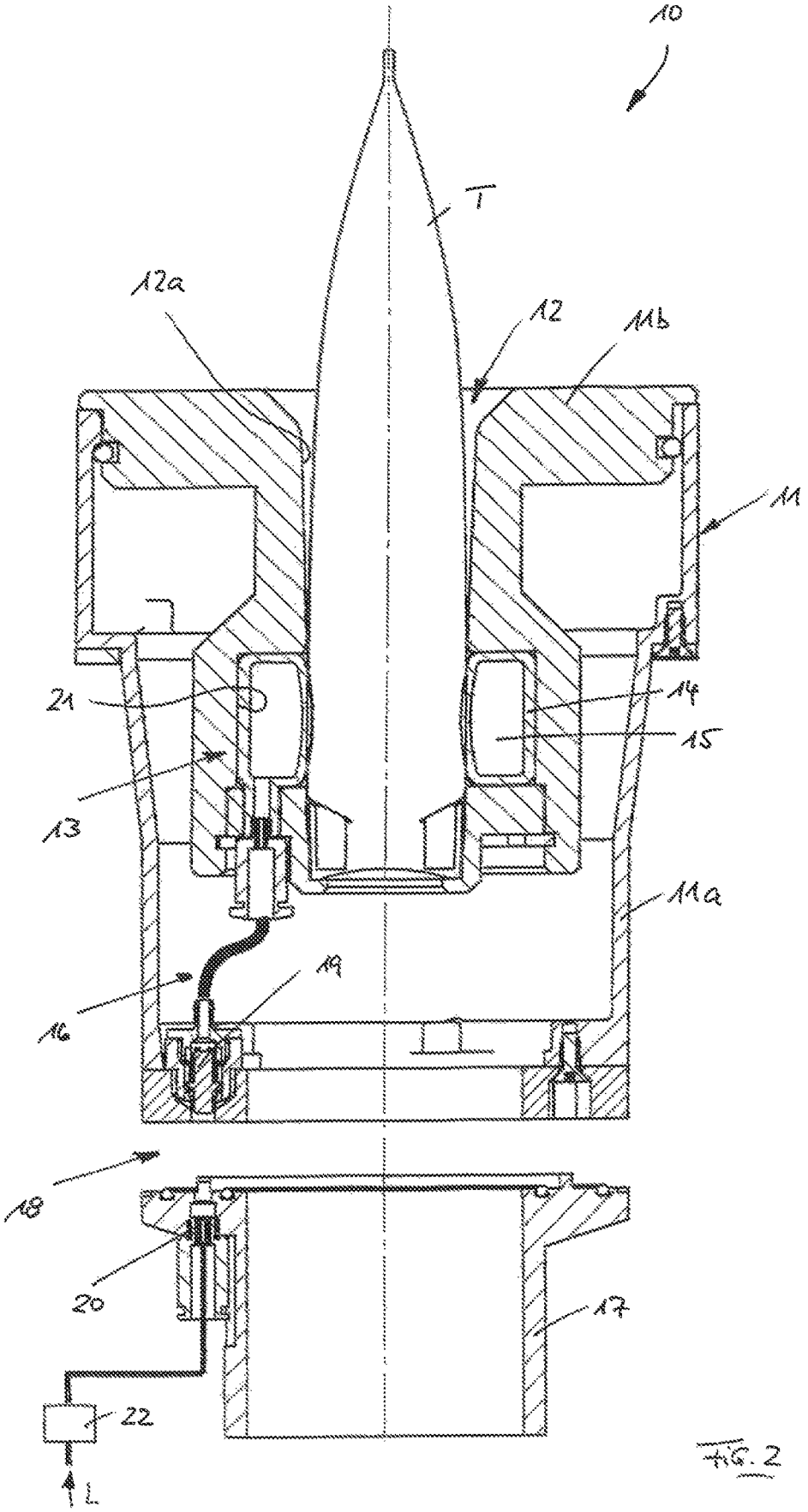
FIG. 2 is a sectional view of the tube holder according to FIG. 1 in the clamped position.

The clamping element 14 remains in its clamping position, in which it applies a clamping force to the tube T, because a nonreturn valve is integrated into the first coupling part 19 of the coupling device 18, even when the housing 11 with the tube T inserted is lifted off from the base part 17 and the connection between the first coupling part 19 and the second coupling part 20 is abolished, as it is shown in FIG. 2.

When the pressure within the inner chamber 15 of the clamping element 14 shall be reduced when the housing 11 is placed on the base part 17, a corresponding projection or pin, which opens the nonreturn valve integrated into the first coupling part 19 when the housing 11 is placed on the base part 17, may be integrated into the second coupling part 20 of the base part 17, so that the pressure escapes from the inner chamber 15 of the clamping element 14 and the clamping element 14 returns again into its releasing position, as it is shown in FIG. 1.

While specific embodiments of the invention have been shown and described in detail to illustrate the application of the principles of the invention, it will be understood that the invention may be embodied otherwise without departing from such principles.

What is claimed is:

1. A tube holder for a tube-filling machine, the tube holder comprising:

a cup-shaped housing, which has an upwardly opening tube mount with an inner wall, into which tube mount an axial end area of a tube can be inserted, the inner wall of the tube mount defines at least one recess configured as a circular ring groove;

a clamping device by means of which a clamping force can be applied to the tube, the clamping device being arranged in an area of the inner wall of the tube mount, the clamping device comprising a feed line and at least one inflatable clamping element with an inner chamber, into which a fluid can be filled under pressure via the feed line, whereby the clamping element can be adjusted between a clamping position, in which a clamping force is applied to the tube, and a releasing position, the clamping element having a ring-shaped hollow configuration and the inner chamber being a ring chamber, the clamping element being arranged in the ring groove;

a base part, wherein the housing is detachably connectable with the base part; and a coupling device arranged in the feed line between the housing and the base part for coupling a portion of the feed line associated with the housing to a portion of the feed line associated with the base part, the coupling being configured to automatically have the portion of the feed line in the base part communicate with the portion of the feed line in the housing when the housing is connected to the base part, wherein the coupling device includes a nonreturn valve configured to open automatically when the housing is placed on the base part.

2. The tube holder in accordance with claim 1, wherein the feed line has a filling valve connected to the portion of the feed line in the base part, the coupling device being arranged between the filling valve and the inner chamber, the filling valve being spaced from the housing.

3. The tube holder in accordance with claim 2, wherein: the clamping element is configured to be deformed into a position in which the clamping element protrudes into the tube mount when fluid is introduced into the inner chamber of the clamping element through the feed line and filling valve.

4. The tube holder in accordance with claim 3, wherein the clamping element fills the recess completely.

5. The tube holder in accordance with claim 1, wherein the housing is held magnetically on the base part.

6. The tube holder in accordance with claim 1, wherein: the inner chamber is surrounded by an elastic deformable material.

7. The tube holder in accordance with claim 1, wherein: the nonreturn valve is configured to maintain the clamping element in the clamping position when the housing is separated from the base part and the coupling device separates the portion of the feed line in the base part from the portion of the feed line in the housing.

* * * * *